United States Patent [19]

Hulbert

[11] 4,136,859

[45] Jan. 30, 1979

[54] INFANT HOLDER

[76] Inventor: Gary F. Hulbert, 700 Robertson Way, Sacramento, Calif. 95818

[21] Appl. No.: 930,911

[22] Filed: Aug. 4, 1978

[51] Int. Cl.[2] ..... A61G 13/00

[52] U.S. Cl. ..... 269/328

[58] Field of Search ..... 269/322, 328; 128/133, 128/134; 5/317, 92, 89

[56] References Cited

U.S. PATENT DOCUMENTS

| | | | |
|---|---|---|---|
| 3,405,931 | 10/1968 | Anderson | 269/328 |
| 3,779,540 | 12/1973 | Boudreau | 269/328 |

*Primary Examiner*—Robert C. Watson

*Attorney, Agent, or Firm*—Lothrop & West

[57] ABSTRACT

An infant holder includes a table preferably reversibly mounted on top of an open-top containing box and releasably secured thereto. On the opposite sides of the table are a pair of uprights, each serving as a pivotal mount for a respective one of a pair of arms. The arms pivot on the uprights toward and away from each other. Over-center mechanisms urge the arms to stay in either of two extreme positions. Secured to the free ends of the arms are the opposite ends of a strap. The length of the strap is such that when the arms are substantially upright, the strap is spaced above the table. When an infant is placed on the strap and lowered to the table, the weight of the infant lowers the strap and pulls the arms over center into a holding position across the infant's torso. If desired, auxiliary leg restraints can also be provided.

8 Claims, 4 Drawing Figures

INFANT HOLDER

BRIEF SUMMARY OF THE INVENTION

Particularly for use by those caring for small infants, there is provided a padded table, preferably on top of a box for containing the table when inverted as well as auxiliary equipment and devices. Uprights at the opposite sides of the table edges extend upwardly to serve as supports for swinging arms operating generally in the same transverse, vertical plane. The arms are resiliently restrained to occupy either of two extreme positions. In one extreme position the arms are joined by a somewhat taut strap spaced above the table. When an infant is placed on the strap, the weight of the infant in tensioning the strap also moves the arms toward each other and downwardly so that they then overlie the infant's torso when the infant is lying over the straps and is supported on the table. When the infant is lifted, the arms and strap can be returned to and retained in original position. A plurality of straps may be used.

DETAILED DESCRIPTION

Figure 3:
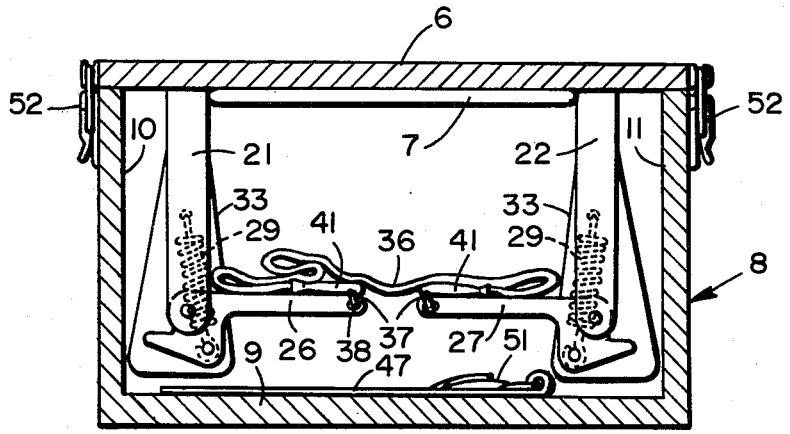
FIG. 3 is a view similar to FIG. 2 but showing the otherwise exposed mechanisms stowed.
Figure 4:
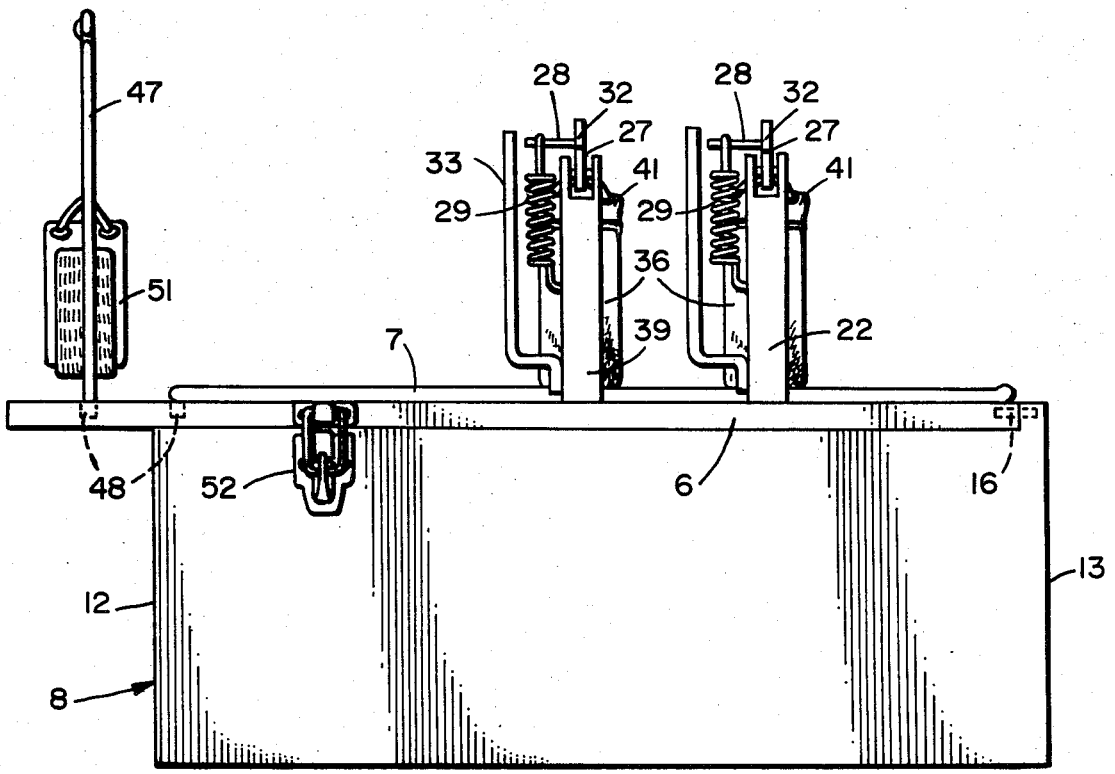
FIG. 4 is a side elevation similar to FIG. 1 but showing the parts in position for holding an infant.

Particularly for use by those affording immediate attention to and attendance upon small infants, there is provided an arrangement for giving a comfortable and acceptable support to the infant and for restraining his torso, particularly, so that he is reasonably restrained and cannot fall off the working support or table when he is being attended to; for example, having his diapers changed. The structure employed preferably includes a table 6, which is a planar sheet of appropriate, relatively stiff material and is preferably provided over most of its area with a pad 7 or comparably comfortable support for an infant. In one, portable arrangement, the table 6 is supported on the upper portion of an open-top box 8 having a bottom 9, sides 10 and 11 and ends 12 and 13. Conveniently, the table 6 is provided with a pair of pegs 16 at one end engageable with suitable apertures in the end 13 so that the table 6 can either be in an erect position, as shown in FIG. 1, or in an inverted position, as shown in FIG. 3.

Figure 1:
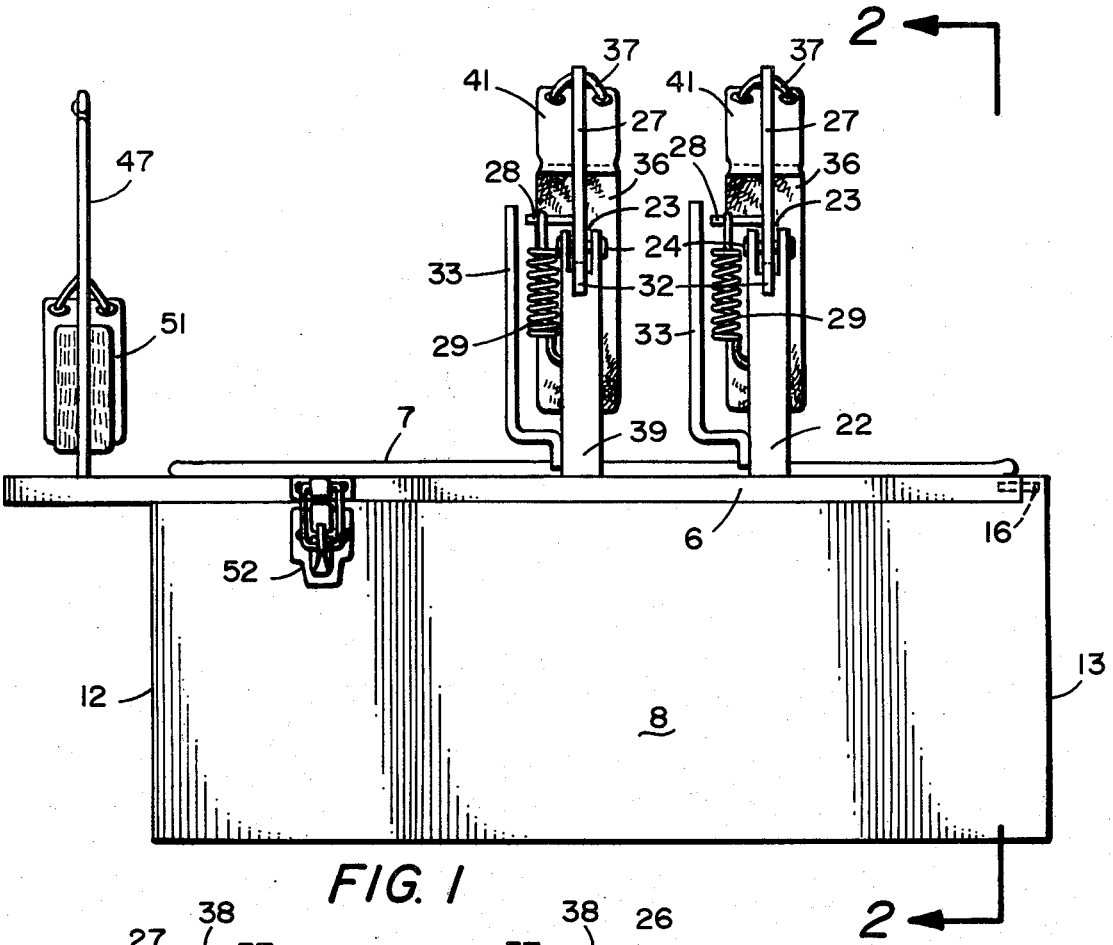
FIG. 1 is a side elevation of an infant holder constructed pursuant to the invention and shown in receptive position.

Upstanding from the table 6 in its erect position, as shown in FIG. 1, is a pair of uprights 21 and 22. These are substantially identical, although of opposite symmetry; and the description of one applies to both. The upright 21, for example, is disposed alongside the edge of the pad 7 and is firmly fixed on the table 6. The upright at its upper end is provided with a slot 23 and a cross pin 24 serving as the pivot mount or center for an associated arm 26, there being a similar arm 27 at the opposite side of the table 6.

Figure 2:
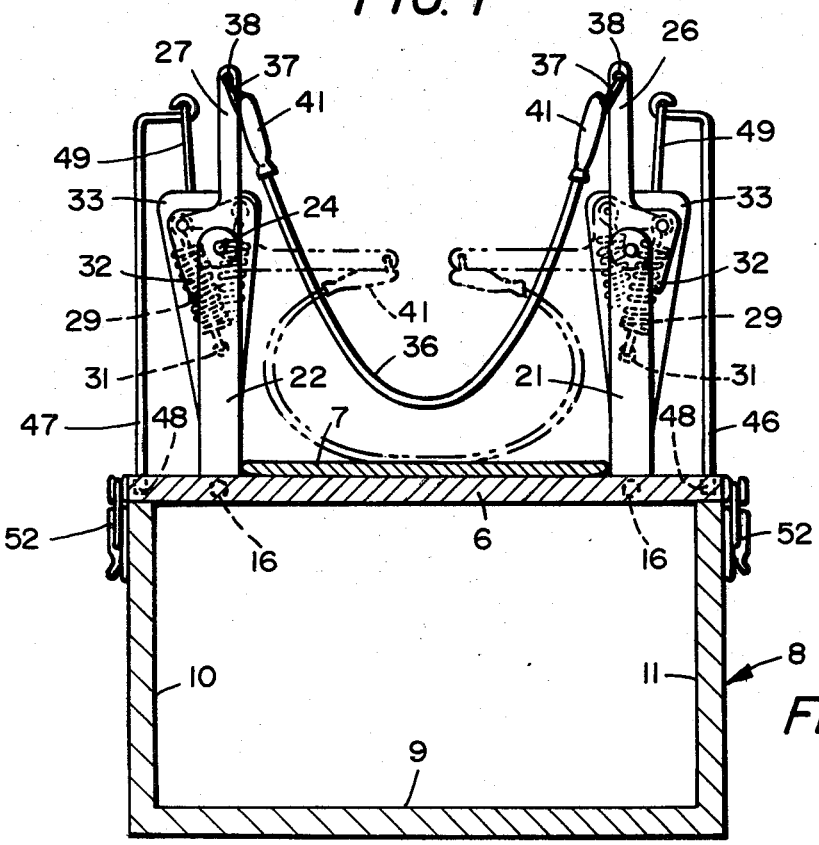
FIG. 2 is a cross-section, the plane of which is indicated by the line 2—2 of FIG. 1.

In order to permit the arm 26 to swing freely within a limited range and also to provide an over-center device for urging the arm away from a central position toward two, opposite extreme positions, there is provided a pin 28 with which a spring 29 or elastic member is engaged at one end. The other end of the spring is secured in an aperture 31 in the upright 21. The arrangement is such that the arm 26 is urged to line up vertically with the upright 21 or is urged into one extreme position, by the spring 29 pulling the arm clockwise, as seen in FIG. 2, until a stop 32 abuts the side of the upright 21. While the spring normally holds the arm upright, the arm can yield to a counterclockwise predetermined force. The spring anchor pin 28 then passes over center of the pivot pin 24, the spring 29 being effective to continue the counterclockwise rotation, as seen in FIG. 2, of the arm 26 into an approximately horizontal, second extreme position.

In order to protect some of the mechanism, a stationary guard plate 33 overlies the upright and the spring 29.

The identical mechanisms in symmetrical array at both sides of the table have the upper or free ends of the two opposite arms 26 and 27 joined by a flexible strap 36. This is preferably of fabric, having end links 37 engaging in apertures 38 in the arms 26 and 27. The length of the strap 36 is such that when both arms are upright, as shown in FIG. 2, the strap hangs naturally but is spaced substantially above the table 6 or the pad 7 thereon.

While but one pair of uprights has been described, sometimes an additional pair of uprights, such as 39 are similarly provided on the table, spaced apart or away from the uprights 26 and 27 but otherwise being duplicates thereof.

In the use of this device, as so far described, the parts are left in the position shown in FIG. 2, with the arms 26 and 27 pointed upwardly and with the strap 36 well above the table 6. The infant, extending longitudinally of the table, is then laid onto the strap 36 so that his weight tensions the strap 36. As he is further lowered, his weight overcomes the predetermined force of the springs 29 and moves the levers 26 and 27 toward each other. They move with increasing resistance toward the center and, passing over the center, then move with decreasing resistance until they occupy substantially the dotted line position of FIG. 2.

At this time the strap and the infant are resting easily on the pad 7. The two arms 26 and 27 have been rotated so that they point almost exactly at each other and lie just above or against the infant's torso, preferably above or against his chest. To make sure there is no undue local pressure, the ends of the strap 36 conveniently carry soft pads 41. The strength of the springs 29 is relatively dissipated in this position, but there is sufficient force to confine the infant in position without in any way hurting him. When a second set 39 of the uprights is utilized, the infant is confined in two places along his torso. This permits whatever operations are to be done upon him to be accomplished without fear of the infant falling off the table or contorting himself so much as to make the job difficult.

When the changing or other operation has been completed, it is merely necessary for the attendant to lift the infant vertically upwardly. The initial lift is effective again to tension the springs. As soon as the springs are tensioned enough to run over or go over center of the pivot points 24, then the springs assist in moving or are effective to move the levers 26 and 27 back to their vertical position and lift the strap 36 to its initial position, as shown in FIG. 2.

As an adjunct, there are sometimes provided a pair of stanchions 46 and 47, substantially duplicates of each other, and arranged in any of several sockets 48 in the table 6. Each stanchion carries a suspended thong 49 at the end of which is an open cuff 51 adapted to be temporarily secured together by a Velcro fastener or the like. The cuffs 51 are sized and positioned to engage the legs of the infant on the table to afford some additional confinement without restricting his movements unduly.

When there is no longer need for the device in a particular location, it can easily be stowed and moved. To that end the stanchions 47 are removed from their securing sockets 48 in the table top 6, and the upright arms 26 and 27 as well as 41, if provided, are folded into a low profile. The table 6 is then removed from the box. The stanchions 46 and 47 and the leg cuffs 51 are then tossed into the interior of the box, and the table 6 is inverted and positioned so that the folded uprights depend into the interior of the box. The table top is then replaced with the pins 16 again entering their sockets for security. If desired, side clamps 52 are secured to hold the entire assembly together. The box thus serves not only as a protector for the rest of the mechanism but also can contain much of the auxiliary equipment attendant upon the use of the device.

I claim:

1. An infant holder comprising a table, a pair of uprights disposed opposite each other at the sides of said table, a pair of arms, means for mounting said arms on respective ones of said uprights for pivotal motion between opposite sides of central positions, means for urging said arms away from said central positions, and a strap at its opposite ends secured to the ends of said arms and of a length to be spaced above said table when said arms are in said central positions.

2. A device as in claim 1 in which said urging means are over-center springs engaging said uprights and said arms.

3. A device as in claim 1 in which said strap length is effective to contact said table and substantially to pass around the torso of an infant lying thereon when said arms are in a pivotal position extending directly toward each other.

4. A device as in claim 1 including pads on said strap adapted to intervene between said arms and the torso of an infant lying on said table.

5. A device as in claim 1 in which said urging means has a force of a predetermined value low enough to be overcome by the weight of an infant resting against said strap when said strap is spaced above said table.

6. A device as in claim 1 in which said uprights, said arms, said mounting means, said urging means and said strap are duplicated on said table at a location spaced along the torso of an infant lying on said table.

7. A device as in claim 1 including means engageable with said table and adapted to be releasably engaged with the legs of an infant lying on said table and engaged by said strap.

8. A device as in claim 1 including an open-top box for supporting said table, and means for releasably engaging said box and said table in a first position with said uprights and said arms in said box and a second position with said uprights and said arms upstanding from said box.

* * * * *